US007490719B2

(12) United States Patent
Parker

(10) Patent No.: US 7,490,719 B2
(45) Date of Patent: Feb. 17, 2009

(54) VOLUMETRIC DISPENSER

(75) Inventor: Rodney Julian Parker, Mid Giamorgan (GB)

(73) Assignee: Wendon Limited, Mid Glamorgam (GB)

( * ) Notice: Subject to any disclaimer, the term of this patent is extended or adjusted under 35 U.S.C. 154(b) by 0 days.

(21) Appl. No.: 10/598,648

(22) PCT Filed: Mar. 2, 2005

(86) PCT No.: PCT/GB2005/000787

§ 371 (c)(1),
(2), (4) Date: Jun. 20, 2007

(87) PCT Pub. No.: WO2005/087606

PCT Pub. Date: Sep. 22, 2005

(65) Prior Publication Data

US 2007/0284265 A1 Dec. 13, 2007

(30) Foreign Application Priority Data

Mar. 9, 2004 (GB) ..... 0405286.6

(51) Int. Cl.
*B65D 25/08* (2006.01)
*B65D 1/02* (2006.01)

(52) U.S. Cl. ..... 206/219; 206/222

(58) Field of Classification Search ..... 206/219, 206/222, 145, 568; 222/417, 448, 454; 141/22, 141/320–322; 215/DIG. 8; 426/115, 120
See application file for complete search history.

(56) References Cited

U.S. PATENT DOCUMENTS

| | | | | |
|---|---|---|---|---|
| 4,151,934 A | | 5/1979 | Saeki | |
| 4,474,312 A | | 10/1984 | Donoghue | |
| 4,690,313 A | * | 9/1987 | Luine et al. | 222/454 |
| 4,903,865 A | | 2/1990 | Janowitz | |
| 4,951,839 A | * | 8/1990 | Kong | 222/47 |
| 5,111,947 A | * | 5/1992 | Patterson | 215/256 |
| 5,810,185 A | * | 9/1998 | Groesbeck | 215/387 |
| 6,068,165 A | * | 5/2000 | Minihane et al. | 222/454 |
| 7,021,481 B2 | * | 4/2006 | St. Germain et al. | 220/254.2 |

FOREIGN PATENT DOCUMENTS

| | | |
|---|---|---|
| DE | 299 16 436 | 2/2001 |
| EP | 0 335 505 | 10/1989 |
| EP | 0 561 322 | 9/1993 |
| GB | 2 294 682 | 5/1996 |
| JP | 2000 085829 | 9/2000 |
| WO | WO 03/106292 | 12/2003 |

OTHER PUBLICATIONS

The British Search Report for British Application No. 0405286.6; Filed Mar. 9, 2004; Date of Search Nov. 22, 2004.

The International Search Report for PCT Application No. PCT/GB2005/000787; Filed Mar. 2, 2005; Date of Completion Jun. 13, 2005; Date of Mailing Jun. 23, 3005.

* cited by examiner

*Primary Examiner*—Bryon P Gehman
*Assistant Examiner*—Ernesto A Grano
(74) *Attorney, Agent, or Firm*—Alston & Bird LLP

(57) ABSTRACT

A shot dispenser comprises a housing (30), and a chamber (50) having a cap (60). The chamber is movable axially of the housing to open an outlet whereby the contents of the chamber can drain past the base. A tear band (32,33) prevents movement of the chamber until removed.

The dispenser permits mixing of two liquids just prior to use.

16 Claims, 9 Drawing Sheets

VOLUMETRIC DISPENSER

BACKGROUND OF THE INVENTION

The present invention relates to a device for dispensing a dose of material, and particularly to a container adapted to dispense into another material, such as a diluent or reactant.

It is known to provide sealed containers of a precise dose of material. Such containers may be used to dispense the dose directly or to dispense the dose into another material to form a mixture. In the first case the dose may comprise a human medicament or a measure of alcoholic beverage. In the second case, the dose may comprise one component of a reactive compound, or a concentrate intended for dilution at the time of use.

A particular problem arises with the packaging of alcoholic beverages, in particular those which comprise a spirit intended for dilution in another liquid, such as gin and tonic. Generally speaking each component is provided separately, either as an individual dose or by way of bulk container. Pre-mixing is unacceptable.

A further difficulty is that a container, such as a glass, must be provided and into which the spirit and diluent is poured. This arrangement requires additional resources, and concentration by the user so as to avoid spillage.

Dispensing containers have been proposed for attachment to the mouth of a bottle, so that manipulation of the container will release the contents thereof into the bottle. Such prior proposals have not been commercially successful.

Similar problems arise in connection with two component reactive materials, such as epoxy resins and the like.

What is required is a dispensing container which is reliable in operation, has a minimum number of components, is inexpensive, and is readily adaptable to existing technology.

SUMMARY OF THE INVENTION

According to the invention, there is provided a shot dispenser comprising:

a housing having an axis, a base transverse to said axis, and a wall upstanding from said base and defining an enclosure;

a chamber within said enclosure and relatively axially movable along said axis between a closed condition in which material therein is contained, and an open condition in which material therein can drain past said base.

In one embodiment the chamber has legs which are non-protruding in the closed condition, and protruding in the open condition.

Such a shot dispenser is inherently adapted against accidental draining thereof whilst standing on a substructure, because the legs of the chamber cannot be moved to the protruding condition. However when placed in or on the mouth of a bottle, the base can be unsupported, and deliberate relative axial movement of the chamber will allow the contents thereof to drain. Furthermore a consumer may hold said wall and move the chamber axially so as to deliberately release the contents over the desired region.

In a preferred embodiment said wall comprises a continuous peripheral surround for the chamber. Preferably said base is annular, and defines on said axis an outlet member. The annular base preferably includes one or more through passages adapted to receive one or more legs of said chamber such that in the closed condition the terminal ends of the legs are flush with the outer surface of said base. In a preferred embodiment four equispaced legs are provided.

The outlet member may comprise a valve comprising a brim attached to said base, a crown, and a pierced side wall between the brim and crown, wherein the crown defines a disc adapted for leak tight fitting in an aperture of said chamber, relative movement of said chamber causing said aperture to approach the brim, and to permit material in the chamber to drain via said pierced side wall. In the preferred embodiment the valve and aperture are concentric about said axis.

Preferably relative movement of said chamber is restricted, and in the preferred embodiment the bottom of said chamber abuts said brim in the open condition.

In a preferred embodiment said cap includes a rim in abutment with said wall to prevent relative movement of said chamber along said axis in the opening direction, release means being provided to allow such relative movement on demand. Alternatively said chamber may include a protruding flange in abutment with said wall to prevent relative axial movement thereof in the opening direction. Preferably the release means comprises a removable or deformable construction between said rim or flange, and wall, such as a tear band. In such an arrangement removal of the tear band allows the chamber to be moved axially towards the base of the housing, and thereby to shift the chamber to the open condition. Whilst the tear band is in place, such relative axial movement is not possible.

Preferably said cap is secured to the chamber by press fit. In a preferred embodiment the cap includes a channel in the underside thereof defining an internal lip which is adapted to engage the upper edge of a side wall of said chamber.

Said tear ring may include means for removing a portion only whereby a circumferentially extending recess is formed to permit said cap to be prised off. Such a recess extends for example around 90°-180° of the circumference only; the remaining portion prevents relative axial movement of the chamber. This arrangement permits the contents of the chamber to be dispensed from the top by removing the cap, and without risk that the chamber will be moved to the open condition.

In a preferred embodiment the tear band comprises clockwise and anti-clockwise portions having adjacent tear tabs to be gripped in the hand. The tabs may be colour coded, or otherwise differentiated, for example by shape. Removal of one portion allows the cap to be removed whereas removal of both portions allows the chamber to be pushed to the open condition.

In the preferred embodiment, the cap, tear band and housing together provide a substantially closed drum having only apertures in the base which are themselves closed by the terminal ends of respective chamber legs. Thus the chamber cannot be accidentally opened, and the contents are secure. In the alternative the legs or circular leg may move in a blind recess of the housing so that the apertures provide the only opening(s) in the base thereof.

Preferably the outer surface of the housing is adapted for leak tight fitting to the mouth of a container. For example the housing may have a smooth circular exterior adapted for tight fitting in the mouth of a bottle, and an external flange to ensure insertion to the desired depth. Alternatively internal or external screw threading may be provided to mate with the usual threads of a plain bottle cap, or a collar may be provided to snap-fit over a crown cork rim.

It will be understood that the shot dispenser can thus be provided as a replacement for a regular cap at the time of use, or may be attached as the sole cap at the time when the container is filled.

A shot dispenser according to the invention is primarily useful for mixing liquids at the time of use. However it will be understood that any flowable material can be contained within the chamber.

BRIEF DESCRIPTION OF THE DRAWINGS

Other features of the invention will be apparent from the following description of a preferred embodiment of the invention illustrated by reference to the accompanying drawings in which.

DETAILED DESCRIPTION OF THE DRAWINGS

Figure 1:
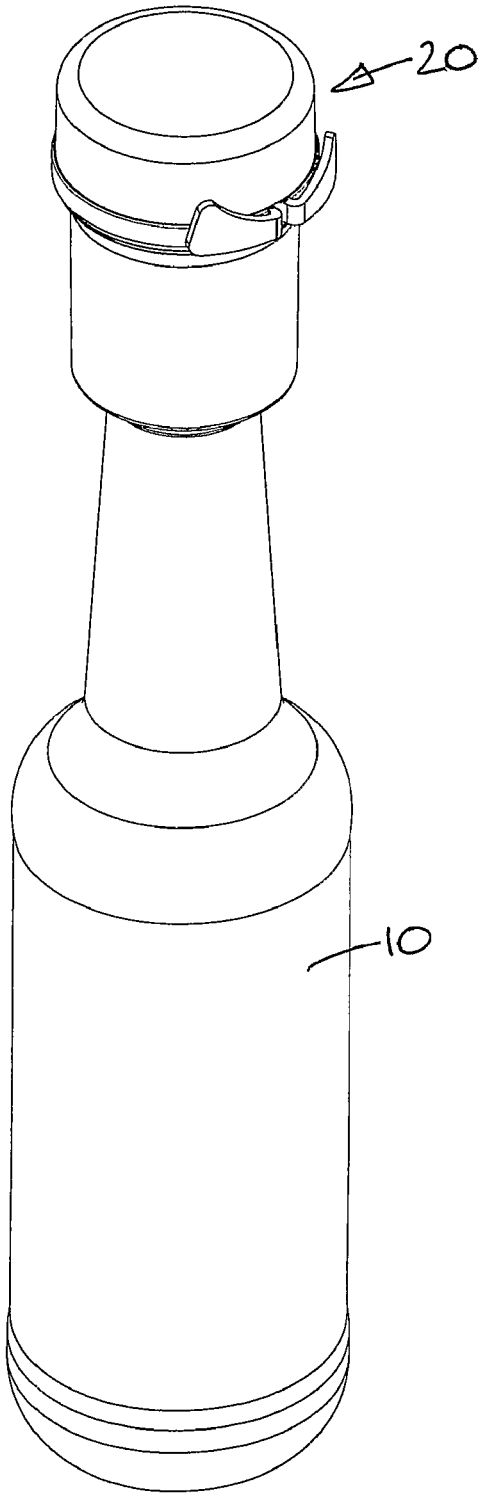
FIG. 1 is a perspective view of a bottle on the mouth of which is mounted a container according to the invention.

FIG. 1 illustrates a typical glass bottle 10 of non-alcoholic beverage, for example a fruit flavoured drink from which a conventional cap has been removed, and to which a shot dispenser 20 according to the invention has been added. As will become apparent, the shot dispenser allows a measure of e.g. vodka to be dispensed into the bottle immediately prior to consumption.

It will be appreciated that the bottle may also be supplied from a drinks manufacturer with the shot dispenser attached in place of a conventional cap. However, by supplying bottles and shots separately, stock holdings may be reduced. Furthermore the bottles and shots may be supplied from different sources, which may be particularly important in the case of spirit based shots to which special taxation and storage regulations apply.

Figure 2:
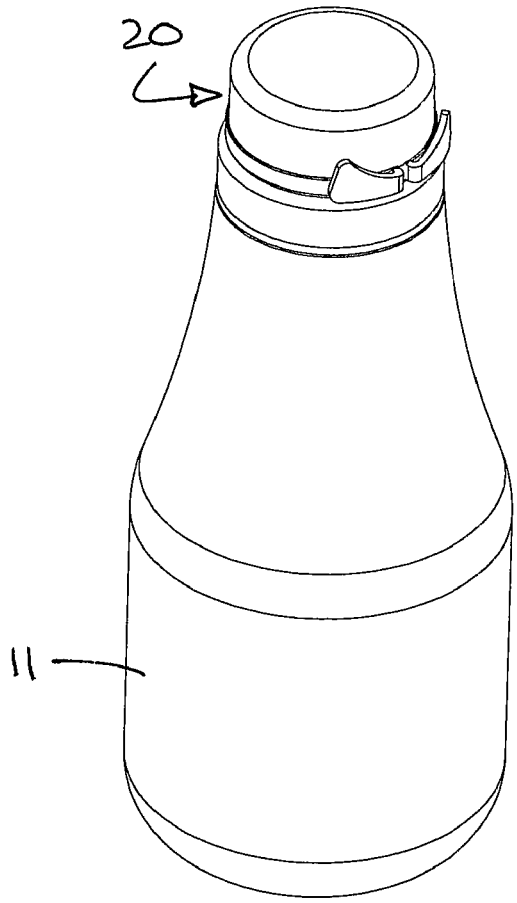
FIG. 2 corresponds to FIG. 1 but shows the container within the mouth of a bottle.

FIG. 2 illustrates the same shot dispenser 20 as FIG. 1; but installed in the mouth of a bottle 11 so as to give a streamlined appearance, and to reduce package volume.

FIGS. 3-6 illustrate the preferred embodiment which comprises three plastic mouldings, namely the housing (FIGS. 4A-D), the chamber (FIGS. 5A-D) and the cap (FIGS. 6A-D).

The housing 30 comprises a cylindrical pot 31 having a double tear band 32,33 moulded around the rim of the mouth. Each tear band is connected to rim by a thin web, and can be removed by grasping and pulling a tab 34. Tear bands of this kind are conventional but usually a single tear band extends 360° around the container. As illustrated each tear band in this embodiment extends around 180° of the circumference of the mouth.

The circumferential wall 35 of the housing extends upwardly inside the tear band and is approximately level with the top thereof.

The base of the housing comprises an annular foot 36 having four equispaced arcuate through passages 37 therein. Within the foot 36, the base defines successively a concentric circular upstanding wall 38, a radial circular ledge or brim 39, another concentric circular upstanding wall 40 and a circular flat crown 41. These portions 38-41 together define part of a drain valve for the shot dispenser.

The inner circular wall 40 has apertures 42 therethrough to connect the interior of the housing with the circular space within the foot 36. Longitudinal ribs 43 are equispaced within the pot 31 to hold the chamber 50 concentric.

The chamber 50 (FIGS. 5A-D) comprises a generally cylindrical well having four equispaced legs 51 extending below the well bottom 52. These legs are somewhat in the shape of a half ellipse as illustrated.

Around the mouth of the chamber are concentric rings 53,54. The thicker lower ring 53 constitutes a bore seal and fits against the interior of the housing 30 in a leak tight manner. The thin upper ring 54 is flexible and rests on the mouth of the wall 35 in the initial condition. These features can be clearly seen in the axial section of FIG. 3E.

Figure 3A:
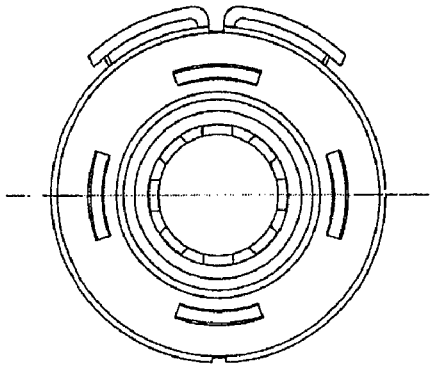
FIGS. 3A through 3E show an assembled container according to the invention in underside plan, (FIG. 3A), cross-section (FIG. 3B), elevation (FIG. 3C), perspective (FIG. 3D), and sectioned perspective view (FIG. 3E)
Figure 3B:
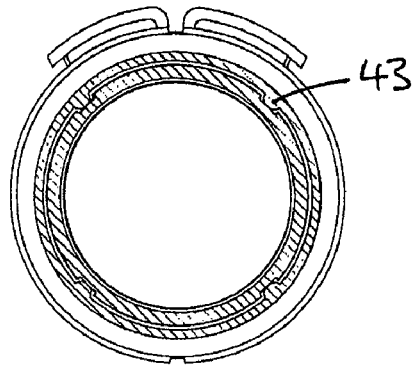
Figure 3C:
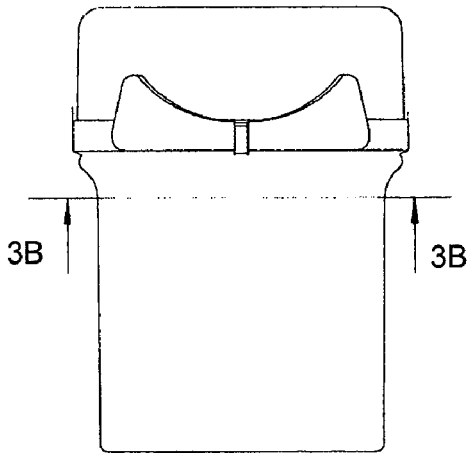
Figure 3D:
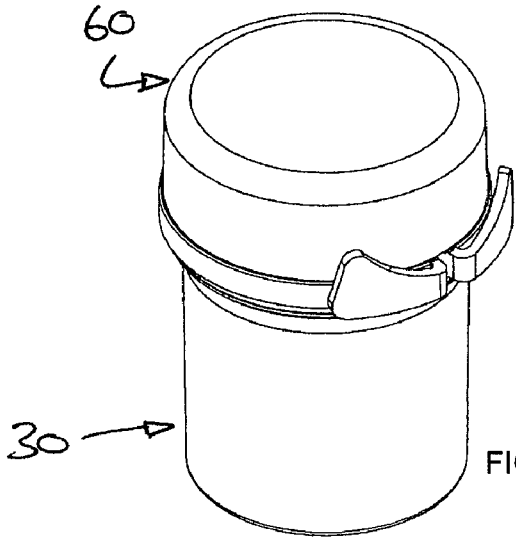
Figure 3E:
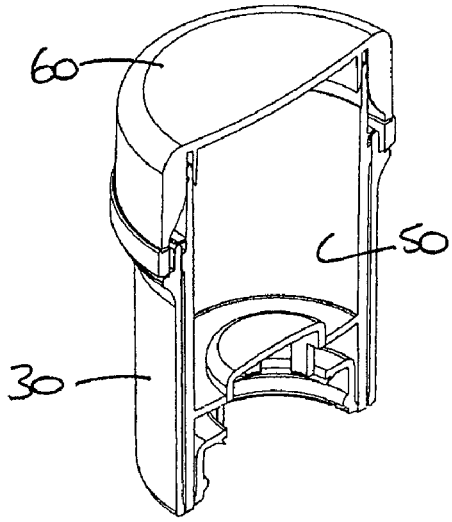
Figure 4A:
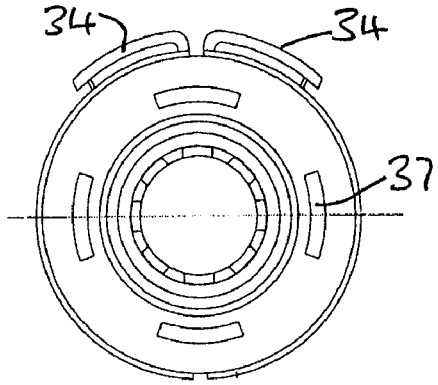
FIGS. 4A through 4D show the housing in underside plan (FIG. 4A), elevation (FIG. 4B), perspective (FIG. 4C), and sectioned perspective view (FIG. 4D)
Figure 4B:
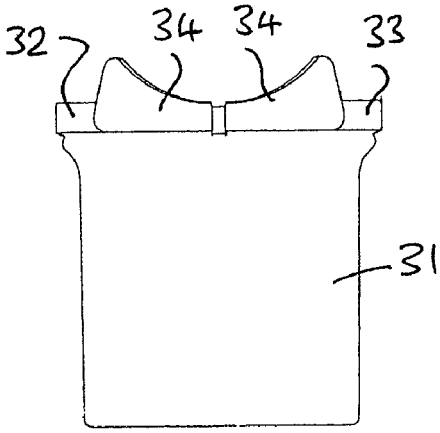
Figure 4C:
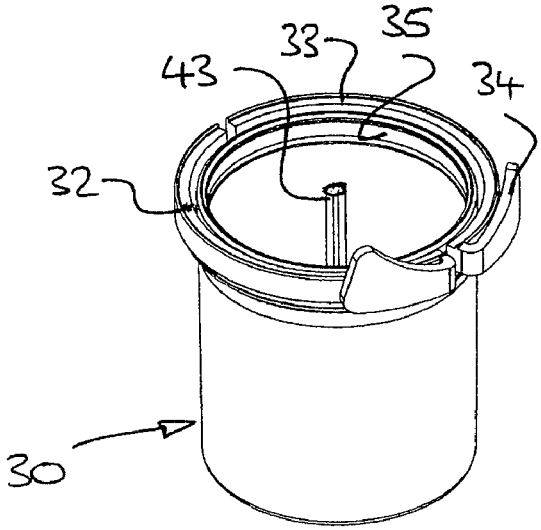
Figure 4D:
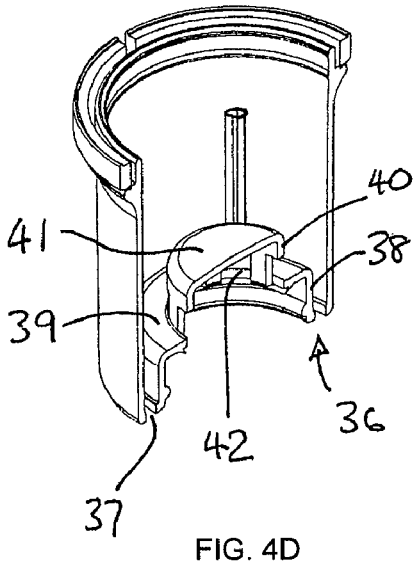
Figure 5A:
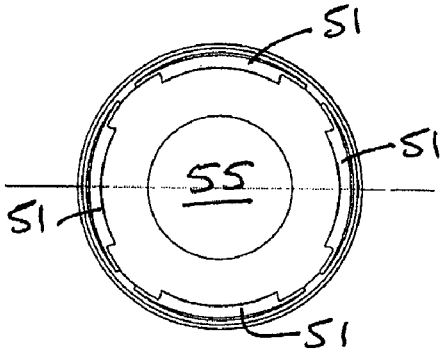
FIGS. 5A through 5D show the housing in underside plan (FIG. 5A), elevation (FIG. 5B), perspective (FIG. 5C), and sectioned perspective view (FIG. 5D)
Figure 5B:
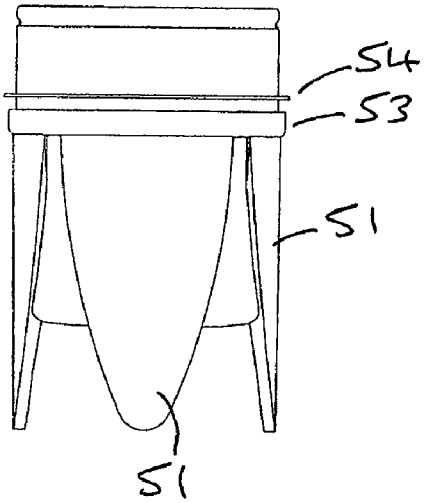
Figure 5C:
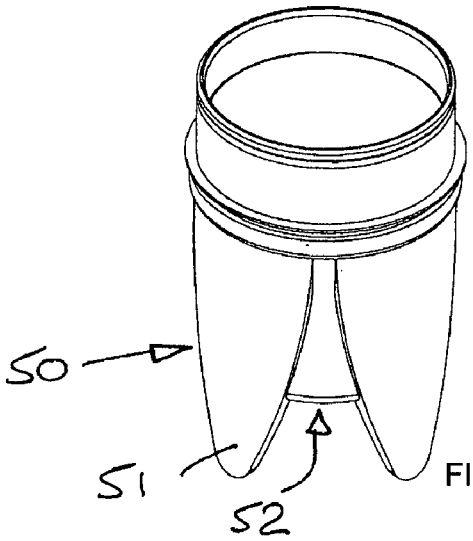
Figure 5D:
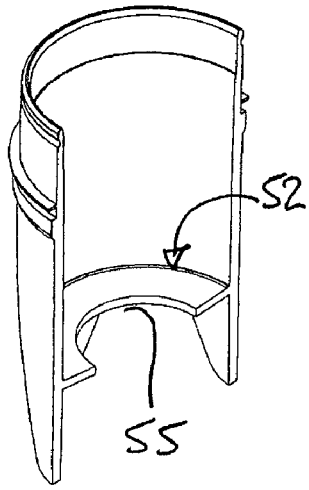
Figure 6A:
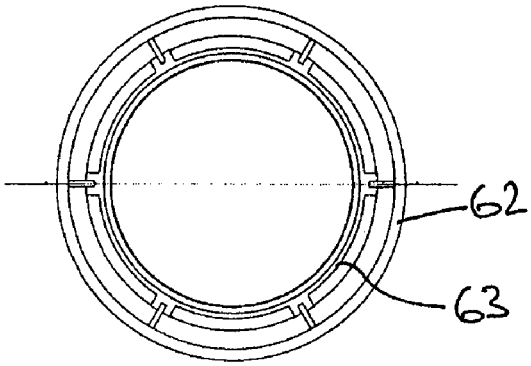
FIGS. 6A through 6D show the housing in underside plan (FIG. 6A), elevation (FIG. 6B), perspective (FIG. 6C), and sectioned perspective view (FIG. 6D)
Figure 6B:
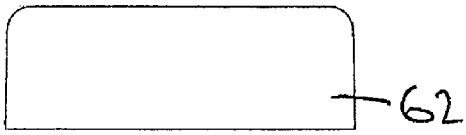
Figure 6C:
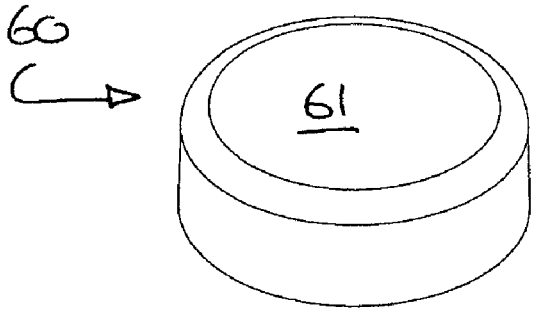
Figure 6D:
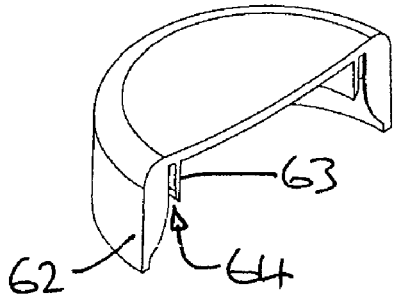

The well bottom 52 defines a circular concentric opening 55 into which the inner concentric wall 40 engages in a leak tight manner, as illustrated in FIG. 3E. The legs 51 locate in the through holes 37 so as to be flush with the annular foot 36, and in this condition, the apertures 42 lie below the well bottom.

The cap 60 (FIGS. 6A-D) comprises a circular disc 61 from which depends a thick edge rim 62 and a concentric circular web 63 of about half height. FIGS. 3A-E show that in use, the thick rim 62 abuts the tear bands, and the space 64 between the rim and web engages the rim of the mouth of the chamber in a leak tight manner. Internal barbs may assist in retaining the cap 60 on the chamber 50, and other conventional means may also be suitable, such as adhesive or welding.

In use the chamber 50 is assembled within the housing 30 on a flat surface so that the legs 51 are prevented from passing through the apertures 37. This ensures that the upper portion of the wall 40 engages in the opening 55 in a precise and leak tight manner. The chamber is then filled with a precise dose of material to be dispensed, and the cap 60 applied. The cap closes the mouth of the chamber in a leak tight manner, and the contents are thus sealed within the shot dispenser.

Figure 7A:
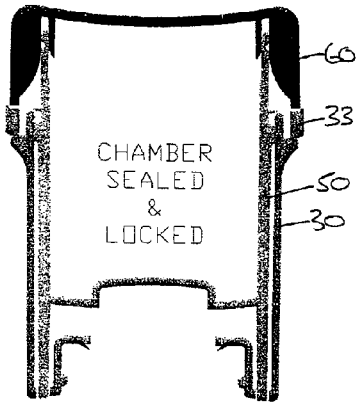
FIGS. 7A through 7C illustrate stages of dispensing the container contents via the base of the housing.
Figure 7B:
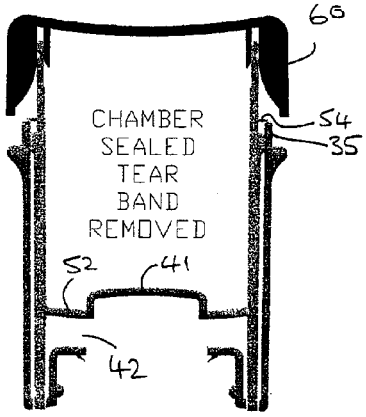
Figure 7C:
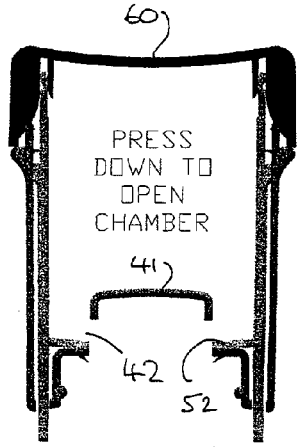

FIGS. 7A-C illustrate one mode of use. In FIG. 7A, the chamber 50 is sealed and locked. In FIG. 7B the double tear band has been removed. In FIG. 7C the chamber contents are dispensed via the opening in the base, and the apertures 42, as the cap 60 is pushed down. The flexible lip 54 passes over the wall 35 at the relatively low, but positive force.

It will be appreciated that the legs 51 can move freely through the through holes 37 once the shot dispenser is placed in the mouth of the bottle. The bottle however remains sealed until the shot dispenser is removed, thus allowing the contents to be mixed, by e.g. shaking, without the risk of contamination.

Alternatively the shot may be dispensed by gripping the periphery of the housing in one hand, whilst pressing down on the cap with the other hand.

Figures 8A, 8B, 8C:
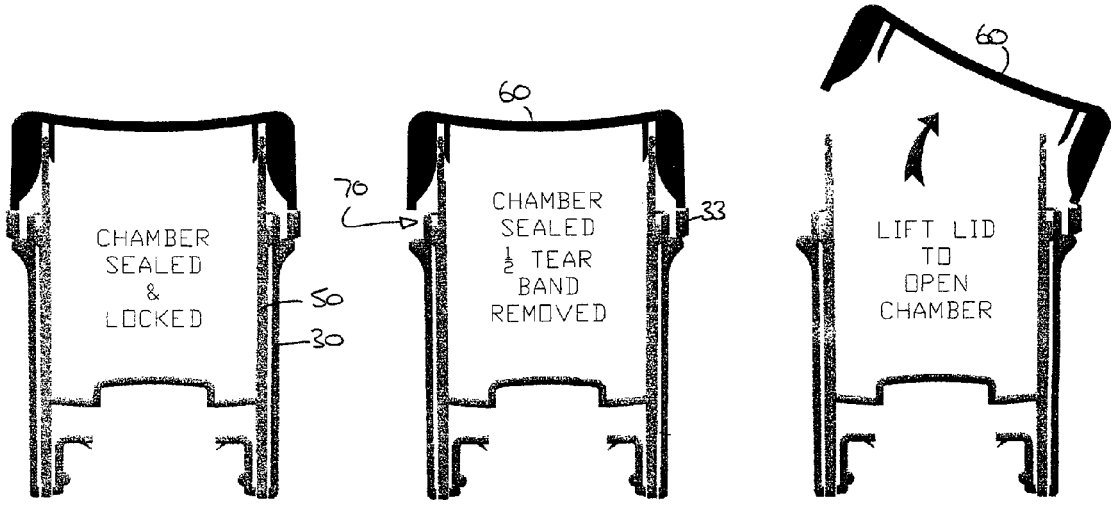
FIGS. 8A through 8C illustrate stages of dispensing the contents of the container via the cap.

FIGS. 8A-C show an alternative mode of use in which only one tear band is removed, leaving the other intact. In this case a recess 70 is provided whereby the cap 60 can be prised off, as illustrated in FIG. 8C. As will be appreciated, this allows the shot to be poured directly rather than via the through holes 42.

Any suitable means may be provided for allowing the shot dispenser to be attached to another container. The housing may for example be a friction fit and have a flange to prevent over insertion thereof. Alternatively external screw threading may be provided to mate with a typical screw threaded container mouth.

Figure 9:
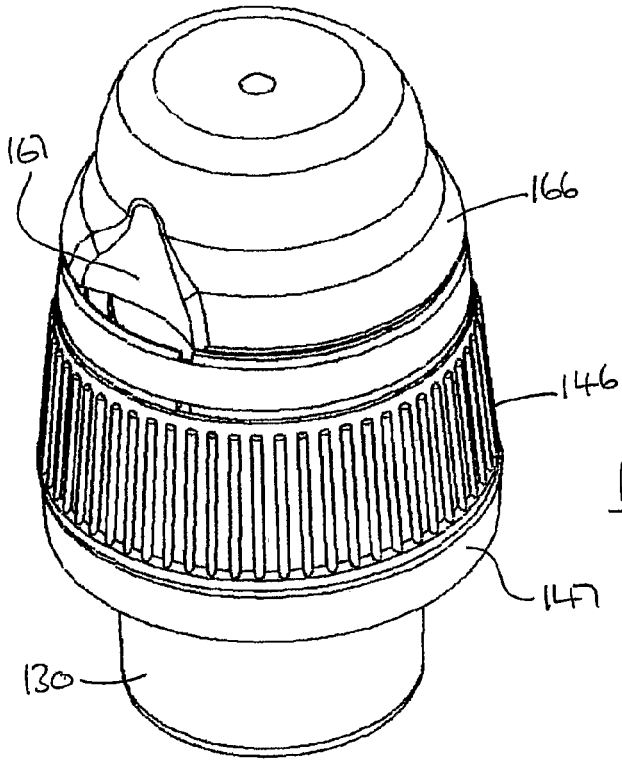
FIG. 9 illustrates an alternative cap from one side and above.
Figure 10:
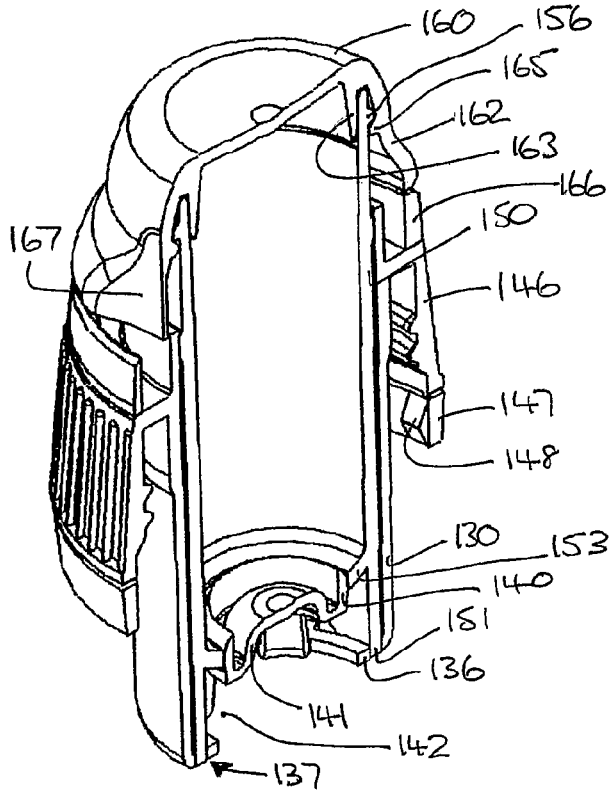
FIG. 10 shows the cap of FIG. 9 in axial section.

A second embodiment of the invention is illustrated in FIGS. 9 and 10, and comprises a screw closure for a bottle incorporating a shot dispenser. In general terms the design is similar to that described with reference to FIGS. 1-8, and corresponding parts have reference numerals increased by 100.

A circular housing 130 has a base comprising an annular foot 136 having a circular upstanding inner wall and a crown 141. The foot 136 has equispaced through passages 137, and the wall 140 has apertures 142.

A concentric depending wall 146 is screw threaded internally for attachment to the screw threaded neck of a container. A lower tear band 147 is removably attached to the wall 146 and has a circular internal protection 148 adapted to engage over the usual neck ring of a container. This lower tear band 147 prevents unscrewing of the cap until it is removed, and is of a generally conventional form.

A chamber 150 has equispaced legs 151 which fit within the through passages 137 as illustrated, and a lower bore seal 153 which defines a concentric opening, and which engages the inner wall 140 in a leak-tight manner. This arrangement is substantially the same as in the embodiment of FIGS. 1-8.

A cap 160 has a circular rim 162 with an internal projection 165 adapted to engage in a snap fit manner over a protruding bead 156 at the mouth of the chamber 150. A circular internal web 163 engages in use on the inside of the wall in a leak tight manner.

Depending from the rim 162 is a tear band 166 having a pull tab 167, the lower end of the tear band 166 is substantially flush with the outer surface of the cap, as illustrated.

Use of this screw cap is somewhat similar to the foot embodiment. Insertion of the chamber 150 into the housing 130 is stopped as the legs 151 contact a support surface on which the foot 136 stands. In this condition the bore seal 153 seals in a fluid tight manner with the wall 140 to permit the chamber to be filled with a liquid shot.

The cap 160 is then pressed on and retained by virtue of the snap fit; the chamber is sealed at the mouth by internal web 163. In this condition the contents of the chamber are sealed; downward movement of the cap 160 is prevented by abutment of the tear band 166 and the screw threaded wall 146, but attachment of the screw closure to a bottle is not prevented.

In use, the closure is screwed onto a container in the usual way, and can be removed in its entirety by tearing off the lower tear band 147.

To dispense the contents of the closure, the upper tear band 166 is removed. This permits the cap 160 to be pushed down, thus uncovering the apertures 142 and allowing the shot to be dispensed into the container. At no time is the shot or the contents of the container open to atmosphere. If required the container can be shaken to mix the contents. For dispensing the cap 160 can be prized off or, more preferably, the closure is unscrewed after removing tear band 147.

The closure may also be emptied directly by simply removing the upper tear band 166 and prizing off the cap 160.

Figure 11:
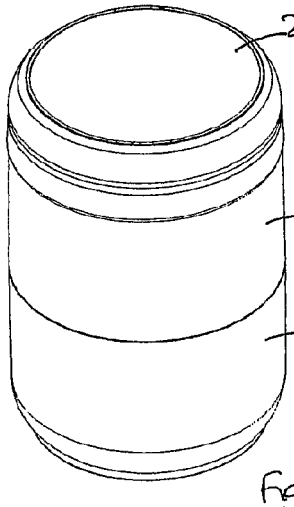
FIG. 11 shows an alternative container at a reduced size.
Figure 12:
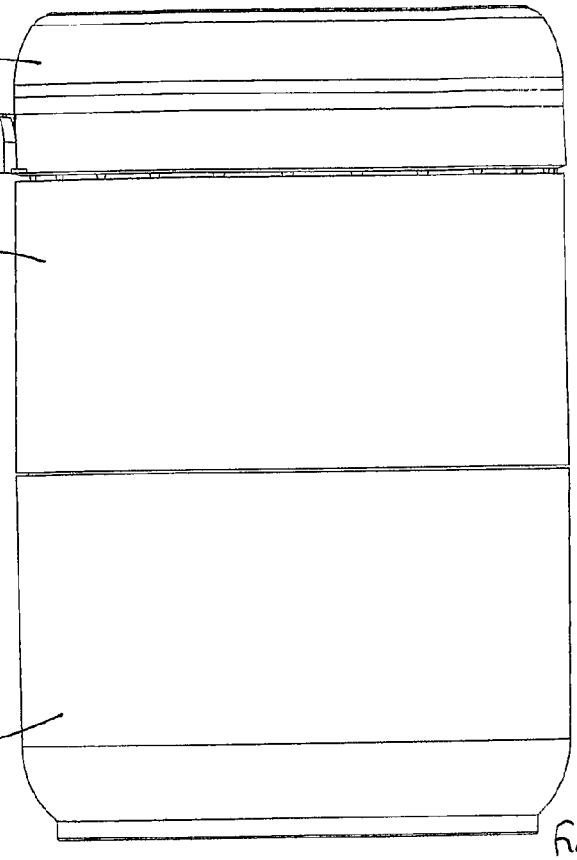
FIG. 12 shows the container of FIG. 11 from the side.
Figure 13:
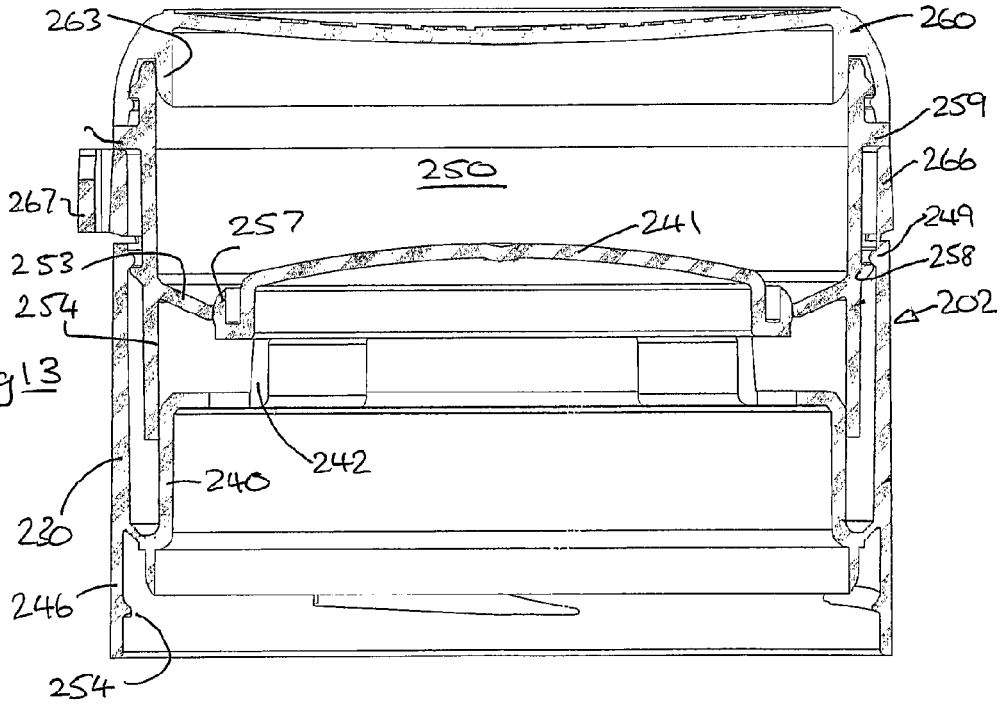
FIG. 13 is an axial section through the upper part of the container of FIG. 12.

A third embodiment of the invention is illustrated in FIGS. 11-13; corresponding parts have reference numerals increased by 200.

A dispensing pot comprises a pot 201, a dispenser 202, and a cap 260. The pot 201 comprises a single wall container having an external screw thread at the mouth (not shown).

The upper dispenser 202 and cap 260 are best illustrated in FIG. 13.

The dispenser 202 has a circular housing 230 which defines an annular cylindrical extension 246 at the lower end, and which has an internal thread 254 for screw engagement with the threaded mouth of the pot 201.

Internally of the dispenser 202 is an inwardly stepped upstanding wall 240 and a crown 241. Equispaced apertures 242 are provided in the wall 240. The crown 241 has a peripheral upstanding annular wall 257 which is somewhat flexible.

Within the dispenser 202 is provided a chamber 250 which comprises a cylindrical wall 254 having a flexible internal lip 253 for leak tight contact with the upstanding wall 257 as illustrated. The volume above the crown 241 and lip 253 constitutes a shot volume.

The lower cylindrical part of wall 254 is guided on the outside of upstanding wall 240. Furthermore the mid-part of wall 254 has an external bead 258 for strap fit engagement on the inner side of a corresponding internal bead 249 at the mouth of the housing 230. Frangibly connected to the mouth of housing 230 is a tear band 266 with tab 267.

The mouth of the chamber 250 is closed by a snap-fit cap 260 which has an annular lip 263 for sealing engagement with the inner side of wall 254. The wall has an annular external flange 259 which bears on the tear band 266 to prevent relative downward movement of chamber 250.

As illustrated in FIG. 11, the external appearance of the assembly is a cylindrical container in which the pot 201, dispenser 202, tear band 266 and cap 260 have a substantially common diameter so that the circular faces are flush.

In use the pot contains one substance, and the chamber contains another; these substances may for example react on being mixed. Typically the dispenser 202 is filled and capped, and then screwed on to the pot 201.

In order to mix the contents, the tear band 266 is removed, thus permitting the chamber 250 to be pressed down by applying force to the cap 260. Downwards movement is arrested as the flange 259 abuts the housing 230. As the chamber moves down the lip 253 disengages the wall 257 to allow the contents of the chamber to flow through the apertures 242. The contents of pot and chamber may be mixed by shaking, and dispensed by unscrewing the dispenser from the pot.

In a preferred embodiment the cap may be attached by a one way latch to prevent removal thereof.

The invention claimed is:

1. A shot dispenser comprising:

a housing having an axis, a base transverse to said axis, and a wall upstanding from said base and defining an enclosure, the housing defining an outlet, wherein said base is circular and centered on said axis, an annulus of said base defining the outlet;

a chamber within said housing and relatively axially movable along said axis in the direction of said base between a closed condition in which material contained in the chamber is prevented from draining through the outlet past the base, and an open condition in which material therein can drain through the outlet past said base, said chamber including a projection in abutment with said wall to prevent relative movement of said chamber along said axis to the open condition, a removable obstruction being provided to allow such relative movement in demand;

wherein said base includes a crown on said axis and which is adapted for leak tight fitting in an aperture of said chamber, relative axial movement of said chamber causing said aperture to uncover said outlet, and to permit material in the chamber to drain therefrom.

2. A dispenser according to claim 1 wherein said wall comprises a continuous peripheral surround for the chamber.

3. A dispenser according to claim 1 wherein said base includes a circular wall extending in the direction of said axis and having a plurality of outlet apertures therein.

4. A dispenser according to claim 1 wherein relative movement of said chamber is restricted, the bottom of said chamber abutting the base in the open condition.

5. A dispenser according to claim 1 wherein said base includes one or more through passages adapted to receive one or more legs of said chamber such that in the closed condition the terminal ends of the legs are flush with said base.

6. A dispenser according to claim 5 wherein four uniformly spaced legs are provided.

7. A dispenser according to claim 1 wherein said projection is a rim.

8. A dispenser according to claim 7 wherein said chamber has a removable cap, a peripheral edge of said cap comprising said rim.

9. A dispenser according to claim 8 wherein said cap is secured to the chamber by snap fit.

10. A dispenser according to claim 8 wherein the cap includes a channel in the underside thereof adapted to engage the upper edge of a side wall of said chamber.

11. A dispenser according to claim 10 wherein said obstruction is a tear band and is adapted for removal of a portion only whereby a circumferentially extending recess is formed to permit said cap to be pried off.

12. A dispenser according to claim 1 wherein said obstruction comprises a tear band between said projection and wall.

13. A dispenser according to claim 12 wherein the tear band comprises clockwise and anti-clockwise semi-circular portions having adjacent tear tabs to be gripped in the hand.

14. A dispenser according to claim 12 wherein the cap, tear band and housing together provide a substantially closed drum having a flush outer surface.

15. A dispenser according to claim 1 wherein the said housing is adapted for leak tight fitting to the mouth of a container.

16. A dispenser according to claim 15 wherein said housing includes a wall depending from said base, and having a thread thereon for engagement with a thread at the mouth of a container.

* * * * *

UNITED STATES PATENT AND TRADEMARK OFFICE

CERTIFICATE OF CORRECTION

PATENT NO. : 7,490,719 B2
APPLICATION NO. : 10/598648
DATED : February 17, 2009
INVENTOR(S) : Parker It is certified that error appears in the above-identified patent and that said Letters Patent is hereby corrected as shown below:

Column 3,
Line 23, “housing” should read --chamber--;
Line 26, “housing” should read --cap--.

Signed and Sealed this

Twelfth Day of May, 2009

JOHN DOLL
*Acting Director of the United States Patent and Trademark Office*